US008459064B2

(12) United States Patent
Haltmayer et al.

(10) Patent No.: US 8,459,064 B2
(45) Date of Patent: Jun. 11, 2013

(54) WATER-CONDUCTING HOUSEHOLD APPLIANCE, IN PARTICULAR A DISHWASHER OR WASHING MACHINE

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 510 days.

(21) Appl. No.: 12/381,886

(22) Filed: Mar. 17, 2009

(65) Prior Publication Data

US 2009/0266427 A1 Oct. 29, 2009

(30) Foreign Application Priority Data

Apr. 25, 2008 (DE) ..... 10 2008 020 884

(51) Int. Cl.
*B08B 3/12* (2006.01)
*D06F 37/00* (2006.01)

(52) U.S. Cl.
USPC ..... 68/3 R; 248/75; 312/229

(58) Field of Classification Search
None
See application file for complete search history.

(56) References Cited

U.S. PATENT DOCUMENTS 4,870,988 A * 10/1989 Hood et al. ..... 137/343
5,582,199 A 12/1996 Schmidt et al.
5,820,168 A * 10/1998 De Giacomoni ..... 285/192
6,311,936 B1 * 11/2001 Herr et al. ..... 248/75

FOREIGN PATENT DOCUMENTS

DE 202005019175 U1 6/2006
DE 102005057322 A1 6/2007

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A water-conducting household appliance includes a drain hose leading out of the household appliance, and a holding element which positions an open line end of the drain hose in a connecting position on an external side of the appliance.

17 Claims, 3 Drawing Sheets

WATER-CONDUCTING HOUSEHOLD APPLIANCE, IN PARTICULAR A DISHWASHER OR WASHING MACHINE

BACKGROUND OF THE INVENTION

The invention relates to a water-conducting household appliance, in particular a dishwasher or washing machine.

Water-conducting household appliances have feed and drain hoses for connection to a water supply network, which hoses are connected during installation of an appliance by a customer or by an installer.

In a generic water-conducting household appliance, at least one water line, in particular a drain hose, leading out of the household appliance is provided, via which water line the waste water is pumped out of the appliance, for example into a house's waste-water disposal system. The drainage line must be laid in as defined a manner as possible inside the household appliance, as vibrations may be transferred through any contact with other components and a vibration noise may arise as a result.

In the generic household appliance, the drain hose is strain-relieved on the inside of the appliance by means of retaining clips so that in the event of pulling forces being applied during installation of the appliance no accidental dismounting of the drain hose can occur. In addition, the drain hose leads out of the appliance for an installation length, which is left in order for the plumber or customer to connect the drain hose to the water supply network.

The line end of the drain hose which leads out of the appliance is not pre-positioned in a fixed manner in the household appliance described hereinabove, which leads to problems at the factory end, particularly in line production. For example, the household appliances conveyed along a production line are for testing purposes connected to a testing device, in order for test water to be pumped out of the household appliance via the drain hose. For this to be done, the line end of the drain hose has to be connected to a contacting piece of the testing device. For the testing of the household appliance known from the prior art, the drain hose is detected manually in a manner which is costly in production engineering terms and then positioned correspondingly on the contacting piece.

SUMMARY OF THE INVENTION

An object of the invention is to provide a water-conducting household appliance in which both appliance installation and handling of the household appliance on the production line are simplified.

The invention is based on a water-conducting household appliance, in particular a dishwasher or washing machine, including a water line, in particular a drain hose, leading out of the household appliance.

The household appliance has a holding element, which positions a line end, in particular an open line end of the water line, in a connecting position on an external side (25) of the appliance. In this way, a defined end position of the line end is achieved, so that in production the water line can automatically be connected by the contacting piece of the testing device and manual positioning of the drain hose can be dispensed with.

For a simple domestic installation, an external water line, i.e. an external drain hose, can also be attached to the household appliance, which line can be connected to the pre-positioned line end on the appliance side and leads to the water supply network.

To automate the aforementioned testing method, the line end of the water line on the appliance side can, in the pre-positioned connecting position, project out of the household appliance for a predefined length and/or at a predefined height.

The thus established connecting position of the water line on the appliance side can correspond to a connecting position of the contacting piece of the testing device. The contacting piece can therefore automatically be connected to or disconnected from the line end of the household appliance to be tested, while the household appliance is conveyed along the production line past the testing device.

It is advantageous if the holding element is provided inside the household appliance in a manner which is simple in production engineering terms with no major component outlay. In this context, the holding element can preferably be embodied of the same material as and/or of one piece with an appliance base, manufactured in particular from plastic. The holding element can be molded here to a raised side wall of the normally tub-shaped appliance base, for example in an injection molding process. In this case, the holding element is not therefore located directly on an external housing wall of the household appliance, but is set back behind, protected from view.

In order to enable easy moving and easy installation of the water line inside the household appliance, the holding element can have a closed or partially open holding frame with a feed-through aperture. When the water line is moved, the line end thereof is guided through the feed-through aperture or inserted therein.

For positioning in the correct position, the line end of the water line can have a positioning stop which engages with the holding element. The positioning stop can be an annular groove provided in the line end and running circumferentially. When the line end is in the connecting position, an aperture edge of the feed-through aperture can project into the annular groove.

For easy installation of the water line on the holding element, its feed-through aperture can have a keyhole shape. The feed-through aperture can have a section with a large aperture-cross-section and a section with a small aperture-cross-section, in which the line end can be pre-positioned in a fixed manner. On the other hand, the line end can be laid in the section of the feed-through aperture with a large aperture-cross-section with play in a pre-installation step. To form the above-mentioned keyhole shape, opposing edge-side locking projections can be provided between the two sections of the feed-through aperture, which locking projections allow a preferred fastening by means of a locking connection. The free gap between these locking projections can be smaller than the groove base of the above-mentioned annular groove on the line end of the water line. For positioning in a fixed manner, the line end can, while elastically deforming the groove base, be pressed past the two locking projections and lock in position with these.

The holding element can additionally be assigned a securing element which secures the line end in its connecting position. In the case of the keyhole shape of the feed-through aperture explained above, the securing element can be a locking plate which is inserted into the section of the feed-through aperture with a large aperture-cross-section once the line end is locked in the correct position in the section with a small aperture-cross-section.

BRIEF DESCRIPTION OF THE DRAWINGS

An exemplary embodiment of the invention is shown below with the aid of the attached drawings, in which.

DETAILED DESCRIPTION OF EXEMPLARY EMBODIMENTS OF THE PRESENT INVENTION

Figure 1:
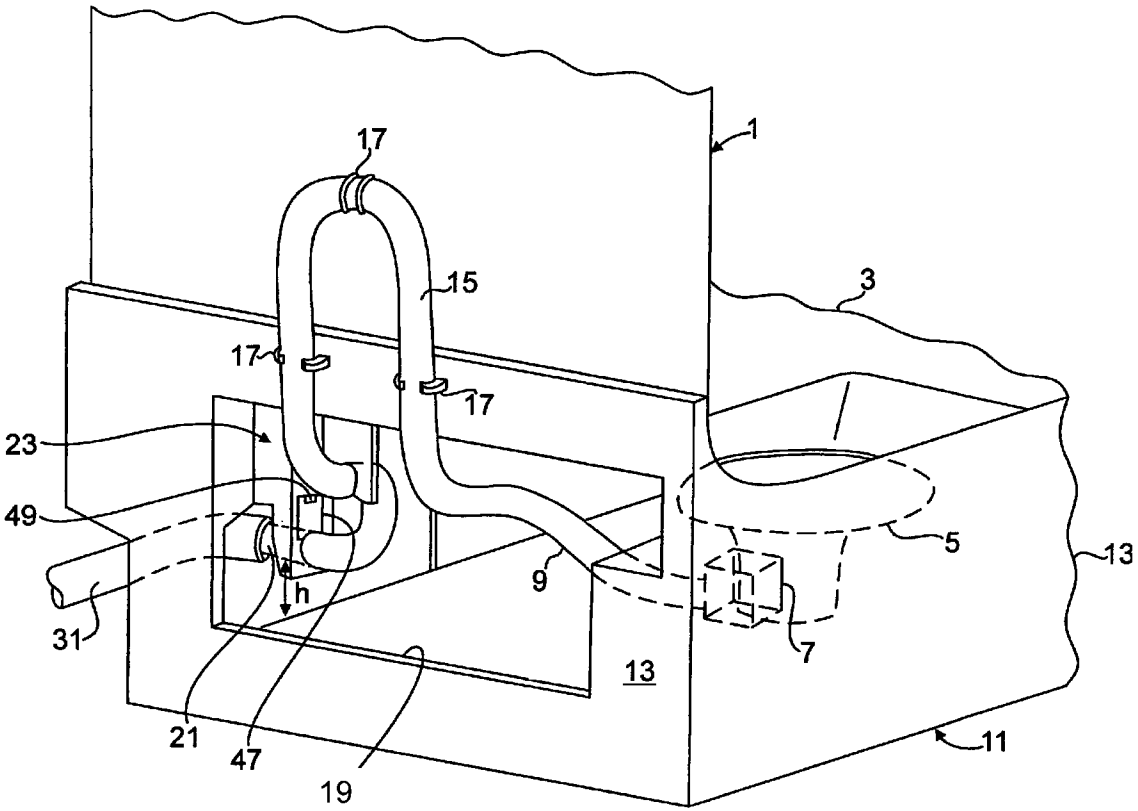
FIG. 1 shows, in a perspective partial view, a dishwasher in which for reasons of clarity housing exterior walls and an appliance door have been omitted.

In the present exemplary embodiment, FIG. 1 shows as an example of a water-conducting household appliance a schematic representation of a dishwasher, components of which are indicated only to the extent that they are required for an understanding of the invention. Thus, in a manner known in the art, the dishwasher has a washing container 1, on the bottom wall 3 of which a pump sump 5, only indicated, is provided. The pump sump 5 has a flow connection to a drain pump 7, via which soiled washing water is pumped out of the dishwasher. For this purpose, the drain pump 7 is connected to a drain line 9, embodied as a drain hose, which leads out of the dishwasher. The pump sump 5 is mounted together with the drain pump 7 in an appliance base 11 embodied, for example, in the shape of a tub, which base has laterally raised side walls 13.

As is further evident from FIG. 1, the drain hose 9 leads via a hose arc 15 leading vertically upward out of a side window 19 of a side wall 13 of the appliance base 11. For safety reasons, the hose arc 15 projects above the washing container base 3 by a predetermined extent, in order to prevent a discharge of washing water from the appliance.

As is further evident from FIG. 1, the drain hose 9 is routed by means of retaining clips 17 in a defined manner inside the dishwasher so as to avoid possible contact with other components.

Figure 3:
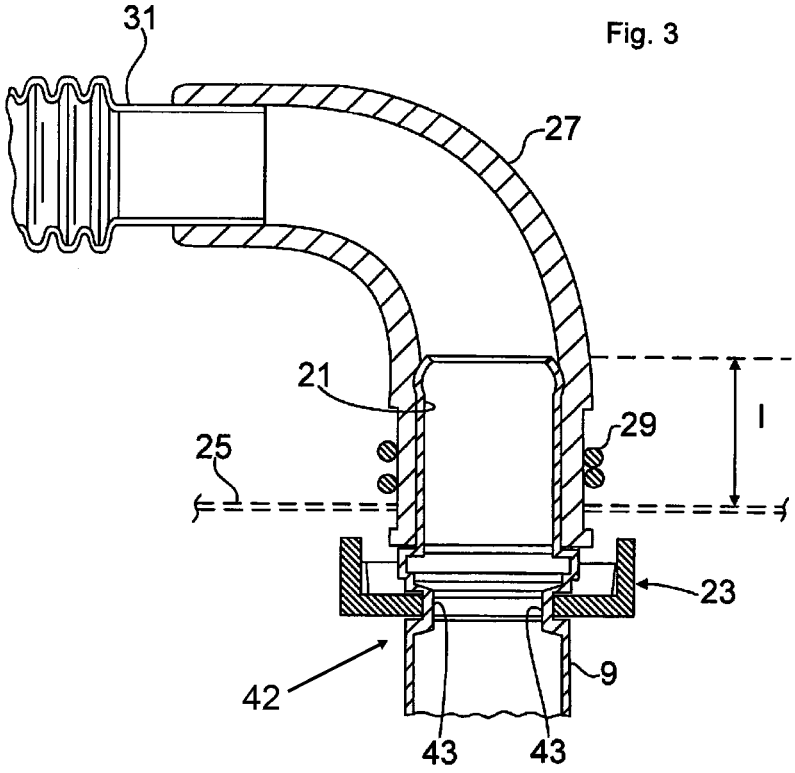
FIG. 3 shows, in a cross-sectional representation from above, a line end pre-positioned in the holding element with an external water line connected thereto.

According to FIG. 1, the line end 21 of the drain hose 9 is pre-positioned in a fixed manner on a holding element 23 in a connecting position. According to FIG. 3, the line end 21 of the drain hose 9 projects in this connecting position by a predetermined length 1 out of an external side 25 of an appliance. In FIG. 3 by way of example an elbow 27 is placed onto the line end 21, and is secured thereto by means of a clip 29. On the opposite end of the elbow 27 there is inserted an external drain hose 31 having a wave-shaped profile, which hose leads to the waste water system. In divergence from FIG. 3, the elbow 27 is omitted in FIG. 1 and the external drain hose 31 is connected directly to the pre-positioned line end 21 of the drain hose 9.

In the connecting position, the line end 21 projects out of the household appliance at a predefined height h for a length 1. Both the height h and the predefined length 1 of the line end 21 are chosen such that in the production process the line end 21 of the dishwasher can be connected automatically by a contacting piece 23, indicated in FIG. 2, of a testing device (not shown). In dishwasher line production, the testing device is provided on the production line and subjects each of the dishwashers conveyed past it to a test run in which the basic functionalities of the dishwashers are checked. For this purpose, a short testing program is performed, at the end of which the test water loaded previously is pumped out via the drain hose 9 and the contacting piece 33.

For connecting to or for disconnecting from the line end 21 of the dishwasher to be tested, the contacting piece 33 is moved to and fro in the longitudinal direction I of the line end 21. Overall, the test run can therefore be carried out fully automatically.

Figure 2:
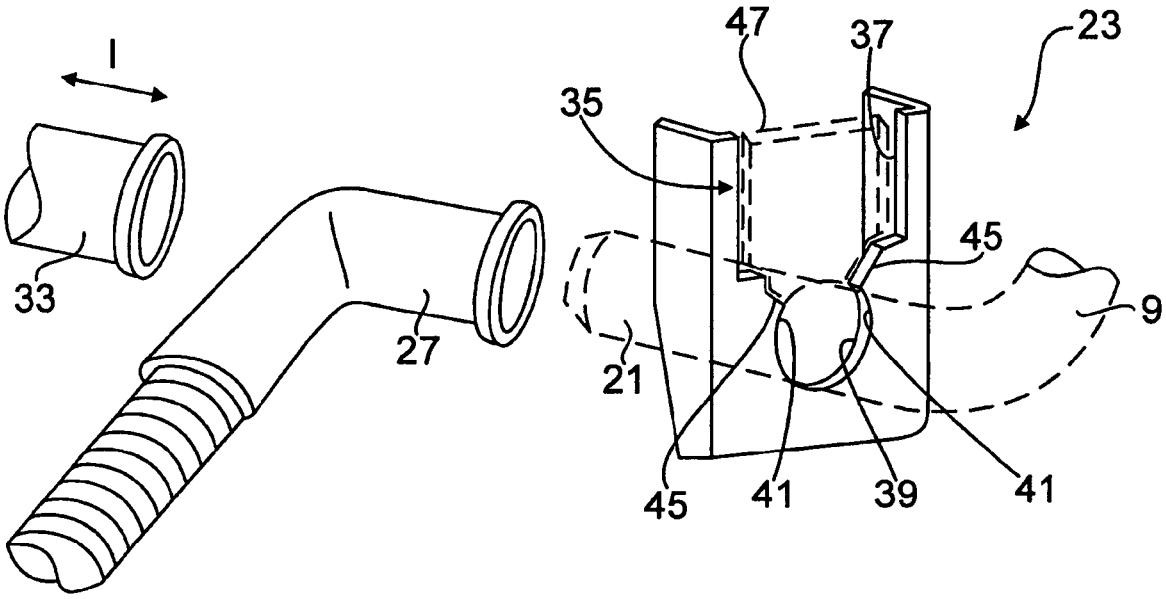
FIG. 2 shows the holding element according to the invention standing alone as well as with assigned water lines.

In the exemplary embodiment shown, the holding element 23 is manufactured together with the tub-shaped appliance base 11 in a plastic injection molding process. Here, as is evident from the figures, the holding element 23 is molded as a closed holding frame on a back side wall 13 of the appliance base 11. The holding frame surrounds a feed-through aperture 35. This feed-through aperture has according to FIG. 2 a keyhole shape having one section 37 with a large aperture-cross-section and one section 39 with a small aperture-cross-section. Locking projections 41 opposing one another on the edge side are provided between the two sections 37 and 39 of the feed-through aperture 35. In FIG. 2, these locking projections extend over the drain hose 9 (indicated only by dashed lines) and secure this hose in a fixed manner in the section 39 of the feed-through aperture 35.

For positioning in the correct position, the line end 21 of the drain hose 9 can have a positioning stop 42 which engages with the holding element 23. For example, in the embodiment of FIG. 3, for positioning in the section 39 of the feed-through aperture 35, the line end 21 has a circumferential annular groove 43, as is shown in FIG. 3. An aperture edge of the feed-through aperture 35 projects into the annular groove 43 of the line end 21, by which means the line end 21 is fixed in its longitudinal direction. In a vertical direction, the line end 21 is secured by the two edge-side locking projections 41, which extend over the drain hose 9.

When the drain hose 9 is laid inside the dishwasher, the drain hose 9 is fixed in a pre-ssembly step to the retaining clips 17 and its line end 21 is guided through the section 37 of the feed-through aperture 35 with a large aperture-cross-section. The line end 21 is then placed with its annular groove 43 on lead-in inclines 45 of the opposing locking projections 34 and the line end 21 is pressed, while being elastically deformed, past the locking projections 34 into the section 39 of the feed-through aperture 35 until it is locked in position. To further secure the line end 21 in its connecting position, a locking plate 47 is provided as a securing element. Once the line end 21 is locked in position in the section 39 of the feed-through aperture 35, this locking plate is inserted into the section 37 of the feed-through aperture 35 and locked in position on the edge side with the aperture edge via locking elements 49 (not shown in detail).

The invention claimed is:

1. A water-conducting household appliance, comprising:

a drain hose having a first portion inside the household appliance and a second portion extending out of a wall of the household appliance; and a holding element entirely located and secured in an interior of the household appliance such that the holding element is prevented from moving with respect to the wall of the household appliance, wherein the drain hose is secured by the holding element such that an open line end of the second portion of the drain hose is pre-positioned in a predetermined fixed connecting position on an external side of the wall of the household appliance and wherein the holding element prevents the open line end of the drain hose from moving to and fro in a longitudinal direction of the open line end of the drain hose such that a contacting piece of a testing device can be automatically connected to the open line end of the drain hose in production of the water-conducting household appliance without forcing the drain hose to move to and fro in the longitudinal direction.

2. The water-conducting household appliance of claim 1, wherein, in the predetermined fixed connecting position, the open line end of the drain hose projects out of the household appliance for a predefined fixed length and/or at a predefined fixed height.

3. The water-conducting household appliance of claim 2, wherein the predetermined fixed connecting position of the drain hose corresponds to a predetermined fixed connecting position of the contacting piece of the testing device on a production line for production of water-conducting household appliances, and which is connectable to the open line end of the water-conducting household appliance for testing.

4. The water-conducting household appliance of claim 1, wherein the drain hose is connected to an external drain hose when the appliance is installed.

5. The water-conducting household appliance of claim 1, wherein the holding element comprises plastic.

6. The water-conducting household appliance of claim 1, wherein the holding element forms a single piece with an appliance base.

7. The water-conducting household appliance of claim 1, wherein the holding element comprises a closed or partially open holding frame with a feed-through aperture, which is disposed inside the household appliance, in which the open line end of the drain hose is inserted in the predetermined fixed connecting position.

8. The water-conducting household appliance of claim 7, wherein the feed-through aperture has a keyhole shape.

9. The water-conducting household appliance of claim 7, wherein the feed-through aperture has a first section with a large aperture-cross-section and a second section with a small aperture-cross-section, in which the open line end is pre-positioned in a fixed manner for pre-mounting the open line end in the predetermined fixed connecting position.

10. The water-conducting household appliance of claim 1, wherein the open line end of the drain hose has a positioning stop that positions the open line end in the holding element in the predetermined fixed connecting position, the positioning stop preventing movement of the open line end in a direction in and out of the household appliance.

11. The water-conducting household appliance of claim 10, wherein the holding element comprises a closed or partially open holding frame with a feed-through aperture, wherein the open line end of the drain hose is inserted in the feed-through aperture, and wherein the positioning stop has an annular groove into which an aperture edge of the feed-through aperture projects when the open line end is pre-positioned in the predetermined fixed connecting position.

12. The water-conducting household appliance of claim 1, wherein the holding element forms a locking connection with the open line end.

13. The water-conducting household appliance of claim 12, wherein the holding element comprises a closed or partially open holding frame with a feed-through aperture, wherein the open line end of the drain hose is inserted in the feed-through aperture, and wherein edge-side locking projections are provided between two sections of the feed-through aperture.

14. The water-conducting household appliance of claim 1, wherein the holding element comprises a securing element which secures the open line end in the predetermined fixed connecting position.

15. The water-conducting household appliance of claim 14, wherein the holding element comprises a closed or partially open holding frame with a feed-through aperture, which is disposed inside the household appliance, wherein the open line end of the drain hose is inserted in the feed-through aperture, wherein the feed-through aperture has a first section with a large aperture-cross-section and a second section with a small aperture-cross-section, wherein a portion of the drain hose is pre-positioned in a fixed manner inside the household appliance in the second section of the feed-through aperture to pre-mount the open line end in the predetermined fixed connecting position, and wherein the securing element comprises a locking plate that is inserted into the first section of the feed-through aperture with the large aperture-cross-section and secures the portion of the drain hose inserted in the second section in a fixed manner with the small aperture-cross-section.

16. The water-conducting household appliance of claim 1, wherein the holding element is fixedly positioned entirely inside a wall of the household appliance and engages the drain hose inside the wall of the household appliance.

17. A water-conducting household appliance, comprising:

an appliance base having a wall and a floor;

a drain pump;

a drain hose having a first line end coupled to the drain pump and a second line end extending out of the wall of the appliance base; and a holding element entirely located and secured in an interior of the appliance such that the holding element is prevented from moving with respect to the wall of the appliance base, wherein the drain hose is secured by the holding element such that an open line end of the second portion of the drain hose is pre-positioned in a predetermined fixed connecting position on an external side of the wall of the appliance base and wherein the holding element prevents the open line end of the drain hose from moving to and fro in a longitudinal direction of the open line end of the drain hose such that a contacting piece of a testing device can be automatically connected to the open line end of the drain hose in production of the water-conducting household appliance without forcing the drain hose to move to and fro in the longitudinal direction.

* * * * *